United States Patent [19]

Mann et al.

[11] 3,977,226

[45] Aug. 31, 1976

[54] SEALING DEVICE FOR INDIRECT EXTRUSION DIE

[75] Inventors: Alfred W. Mann, Rockwall; Jack B. Strother, Terrell, both of Tex.

[73] Assignee: Texas Extrusion Corporation, Rockwall, Tex.

[22] Filed: Mar. 24, 1975

[21] Appl. No.: 561,641

[52] U.S. Cl. ..... 72/273; 72/253 A; 72/467

[51] Int. Cl.[2] ..... B21C 25/00

[58] Field of Search ..... 72/272, 273, 467, 468, 72/253, 255, 264, 269, 254, 256; 207/6.1, 6.2, 10.5

[56] References Cited

UNITED STATES PATENTS

| | | | |
|---|---|---|---|
| 3,522,721 | 8/1970 | Whiting | 72/273 X |
| 3,630,064 | 12/1971 | Mahns | 72/273 X |
| 3,727,448 | 4/1973 | Mann | 72/255 |
| 3,736,786 | 6/1973 | Wagner | 72/255 |
| 3,815,663 | 6/1974 | O'Connor et al. | 164/120 X |

*Primary Examiner*—Lowell A. Larson
*Assistant Examiner*—D. M. Gurley
*Attorney, Agent, or Firm*—Pennie & Edmonds

[57] ABSTRACT

A sealing element for a die which may be used in indirect extrusion is disclosed. The sealing element is in the form of an annular member removably supported on the die. The sealing element has an outer dimension greater than that of the die and one which closely conforms to the inner dimension of a container through which the die is adapted to move. The sealing element provides a lip forming a radially inwardly directed extension of its forward surface, which lip overlies the line of junction between the sealing element and the die.

17 Claims, 6 Drawing Figures

SEALING DEVICE FOR INDIRECT EXTRUSION DIE

BACKGROUND OF THE INVENTION

Apparatus and procedures for indirect extrusion of extrudable material through a die are well known in the art. Such apparatus suffers to some extent from the requirement that after each extrusion stroke the die must be removed from the ram prior to retraction of the ram through the container and then reattached prior to the extrusion stroke. Conventionally, the die has been formed to provide a sealing, sliding fit with the container's inner wall during the extrusion stroke of the die. Yet, because of this sealing fit and due to a build-up of a shell of the material being extruded on the inner wall of the container, movement of the die in the retraction direction through the container is impeded. If the die is not removed from its supporting ram at the end of each extrusion stroke, excessive force is required to carry out complete retraction. The shell of material can cause the die to wedge in the confines of the container during retraction. Damage to either die or container or both may result. Further, retraction of the assembled die and ram requires an increase in the size and strength of the assembly and associated structure.

Where, on the other hand, the die is removed from the ram prior to retraction of the latter, a dead cycle time is produced in the extrusion process. This obviously increases the cost of operation of the equipment and the cost of the products being produced.

The prior art U.S. Pat. Nos. 3,630,064 and 3,522,721 discuss the above problems and set out certain solutions of the same. To this end, both patents disclose a composite die structure. The composite die structure includes a die holder and a die insert received in the holder and having an extruding orifice.

In the structure disclosed in U.S. Pat. No. 3,630,064, the die holder is formed with a first circumferential flange for coupling it to the ram structure. A second, larger circumferential flange serves to provide a seal at the wall of the container during only an extrusion stroke. This second flange remains spaced from the inner wall of the container at all times other than during an extrusion stroke. Elastic radial expansion of the die holder during the extrusion stroke effects the sealing relation with the container. The die holder and insert have beveled surfaces which mate together in a wedging action.

While the structure disclosed in U.S. Pat. No. 3,630,064 provides easy retraction of the assembled die and ram, it suffers from the disadvantage that extrusion material will tend to enter into the gap formed by the mating beveled surfaces of the die insert and the die holder. The material may cause damage to the structure. Also, the die holder tends to become tightly wedged onto the die insert during repeated use tending to permanently enlarge the outer dimension of the die holder and thus decrease the clearance initially designed for permitting easy retraction.

In the structure disclosed in U.S. Pat. No. 3,522,721 the die holder is supported on the end of the ram in encircling relation with the die insert. The die holder is removed after each extrusion stroke and the ram with the attached die insert is retracted through the container. The die holder is annular in shape, completely surrounds the die insert to protect it, and has an inner conical surface adapted to mate with the exterior conical surface of the die insert.

By having the die holder seated against the end of the ram rather than on the die insert, there will be no wedging action of the die holder and die insert as may be produced in the structure of U.S. Pat. No. 3,630,064. However, without any tight precise fit of the mating surfaces of the die holder and die insert and, to some extent, even where there is a very precise fit of these two members, billet material tends to become extruded between the mating surfaces during the extrusion stroke. As indicated above, this can cause damage to the die holder and die insert and can also upset the relationship between the dimensions of the die holder and container wall.

BRIEF DESCRIPTION OF THE INVENTION

The present invention seeks to overcome the problems in the prior art; and as an important aspect thereof, contemplates a sealing element removably positionable on the extrusion die. The sealing element is annular in shape and is received substantially within a peripheral cutout in the forward face of the die and at least partially supported by the shoulder on the die formed at the cutout. The sealing element has an outer dimension greater than the outer dimension of the die. The sealing element provides a sealing fit with the inner wall of the container through which it slides during an extrusion stroke. The sealing element also has a radially inwardly extending lip overlying a portion of the forward face of the die for purposes of covering the line of juncture between the mating surfaces of the die and sealing element. This lip effectively seals this line of juncture against the ingress of billet material during an extrusion stroke. The lip of the sealing ring, in conjunction with the forward face of the die, also provides a supporting function for the ring.

In a first form of the invention, the die at the cutout provides a frustoconical surface which mates with a similar surface formed on the sealing element. The tapered surfaces permit ease in mounting the sealing element on the die. In a second form of the invention, the cutout in the die member is formed along a surface which is coaxial with the axis of the ram. The mating surface on the sealing element is formed complementary thereto. In both of these forms, the cutout provides a support shoulder, acting in cooperation with the forward face of the die, for supporting the sealing ring directly on the disc member.

In a third form of the invention, the die member is formed with a frustoconical surface which mates with a similar surface formed on the sealing element. Instead of having a support shoulder for the sealing element, however, the die member is cut away to a dimension less than that of the backup structure for the die. Thus, the sealing ring engages directly against this structure which functions together with the front face and frustoconical surface of the die to support the sealing element.

As a further aspect of the present invention, the sealing element may be tapered along part of its outer surface, leaving only a portion thereof extending axially of an parallel to the inner wall of the container. By means of the tapered outer surface, the area of the sealing element which contacts the container wall is kept to a minimum.

DETAILED DESCRIPTION

Figure 1:
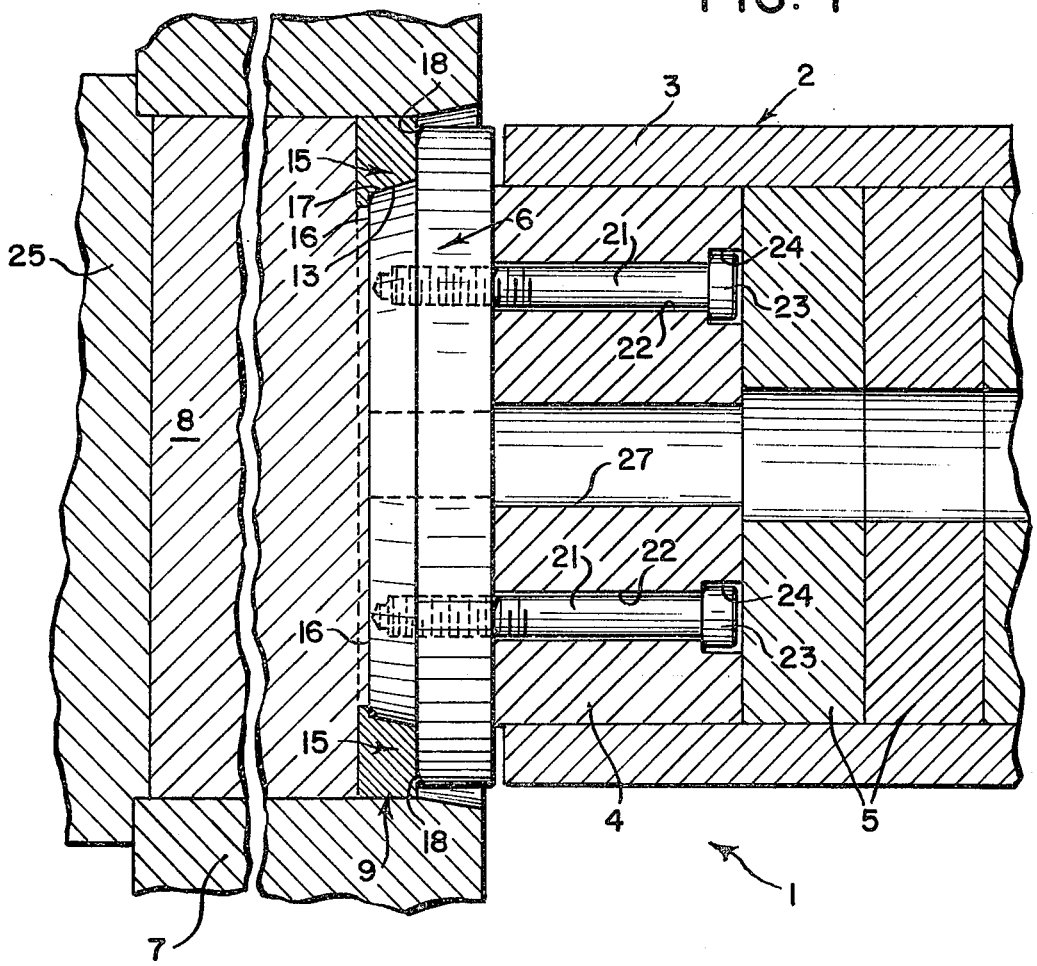
FIG. 1 is a fragmentary elevational view, partially in section, of the die, sealing element and container of apparatus suitable for use in an indirect extrusion procedure.

The indirect extrusion apparatus 1 illustrated in FIG. 1 generally includes a ram 2, a guide tube 3, a plurality of supporting backup disc members 4, 5 disposed within the tube 3, and a die 6 carried by the forwardmost discs 4. There is also a container 7 for supporting therein a billet 8 of material to be extruded. The billet 8 is formed of a material suitable for indirect extrusion such as aluminum. A sealing element 9 is received on the die 6 in a manner as is illustrated in FIG. 1 and discussed below.

As illustrated, the guide tube is spaced from the underside of the die. Since no extrusion forces are communicated to the guide tube through the die, the guide tube which serves to orientate axially each of the blocks forming a part of the ram may be formed of low strength material. One or more dowel pins (not shown) serve to orientate rotationally the discs 4 and 5 relative to each other.

Figure 2:
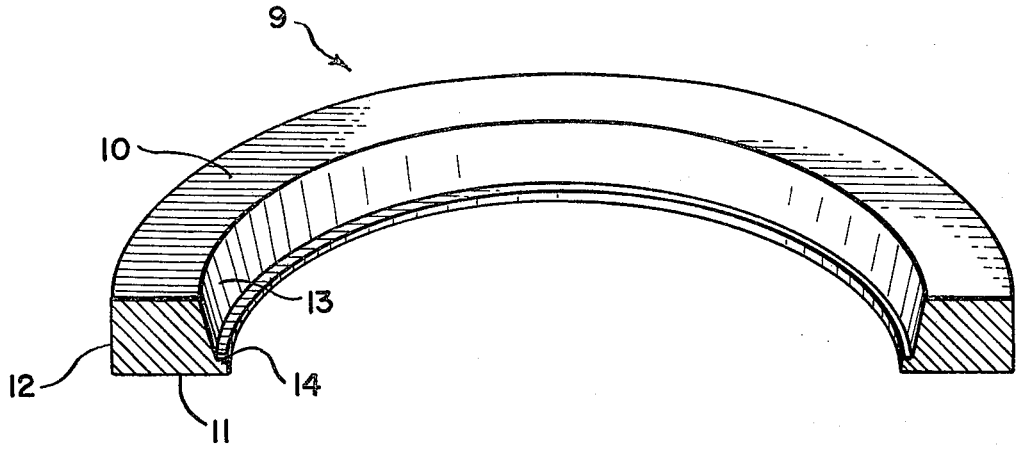
FIG. 2 is a perspective sectional view of the sealing element as illustrated in FIG. 1.

In accordance with the teachings of the present invention, one form of the sealing element is shown in FIGS. 1 and 2. As illustrated, the sealing element is annular in shape and includes a base surface 10, a top surface 11, an outer peripheral surface 12, and an inner surface connecting the base and top surfaces. The inner surface is formed by a beveled surface 13 which terminates at the underside of a lip 14 providing an inwardly directed extension of the top surface 11.

As shown in FIG. 1, the die 6 to be used with the sealing element of FIG. 2 is formed with a cutout 15 along the periphery of its forward face 16. The cutout provides a beveled surface 17 between the forward face and a shoulder 18. The beveled surface 17 mates substantially with the beveled surface 13 of the sealing element, while the shoulder 18 supports the sealing element at its base surface 10 on the forward face of the die 6. As shown in FIG. 1, the outer dimension of the sealing element 9 is larger than the outer dimension of either the die 6 or guide tube 3. More particularly, the outer dimension of the sealing element is substantially equal to the inner wall dimension of the container 7; whereas, both the die and guide tube, being of smaller outer dimension, will be spaced from the inner wall of the container during an extrusion and retraction stroke.

With the construction described above, the sealing element provides two seals against the movement of billet material during the extrusion stroke. First, the sealing element has a sealing, sliding contact with the inner wall of the container to prevent passage of billet material around the outside of the sealing element during the extrusion stroke. Also, the sealing element precludes ingress of billet material between the mating surfaces 13 and 17. This sealing feature is achieved by the lip 14 of the sealing element which when the sealing element is mounted on the die 6 slightly overlies the junction of the mating surfaces 13 and 17 of the sealing element and the die at the forward face 16 of the die. In addition to the above, the construction of the sealing element and its manner of mounting prevents wedging of the sealing element onto the die during an extrusion stroke, even though the mating surfaces 13 and 17 are conical. Wedging is prevented due to the fact that the sealing element is supported directly on the shoulder 18 of the die. Additionally, the sealing element can be dimensional so that further support is provided by the lip 14 of the sealing element on the forward face 16 of the die. By avoiding wedging of the sealing element on the die, the sealing element may be removed easily from the die 6 at the completion of each extrusion stroke.

Since the container inner wall dimension is larger than that of any of the ram elements, the ram may be readily retracted through the container for purposes of introducing a further billet into the container prior to commencement of a following extrusion stroke of the ram and sealing element received thereon. The entrance to the container adjacent to the ram is tapered slightly throughout a short length to assist in entry of the sealing element into the container at the commencement of each extrusion stroke. The length of taper is such that when extrusion begins the seal between the inner wall and the sealing element is present.

Figure 3:
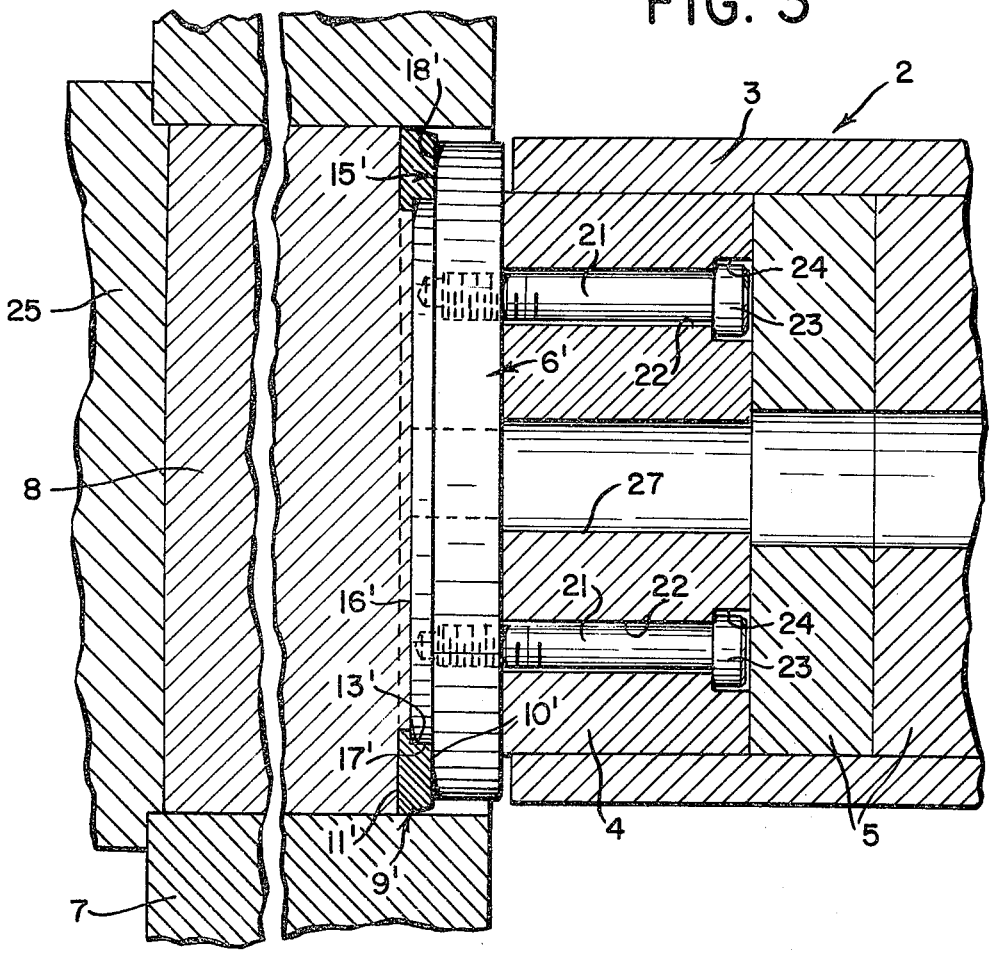
FIG. 3 is a view similar to the view in FIG. 1 illustrating a different form of sealing element which may be employed in the indirect extrusion apparatus.
Figure 4:
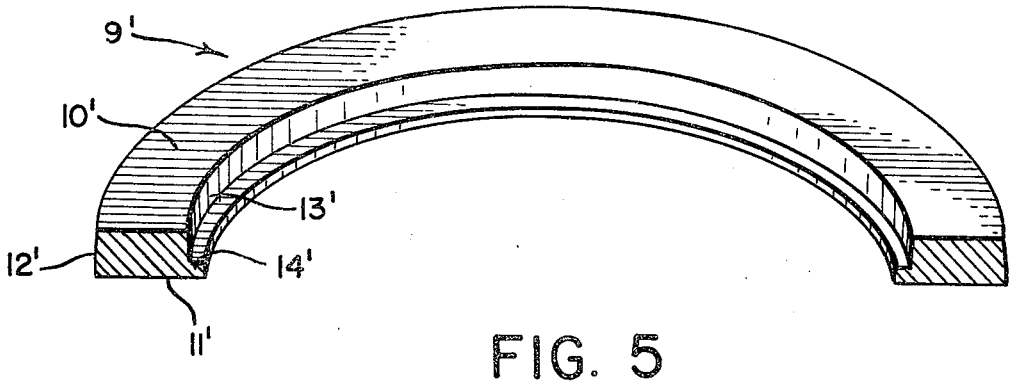
FIG. 4 is a perspective sectional view of the sealing element as illustrated in FIG. 3.
Figure 5:
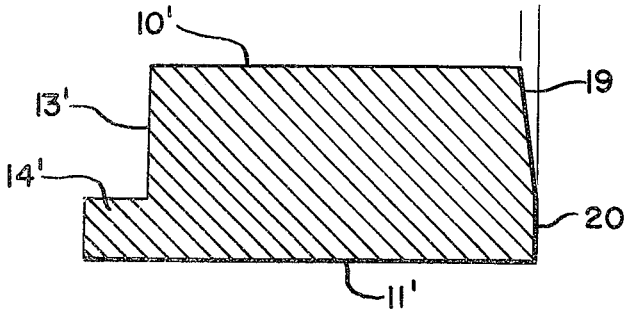
FIG. 5 is an enlarged view in cross-section of the sealing element of FIG. 4.

A second embodiment of the invention is illustrated in FIGS. 3–5. The operation of the general construction of the embodiment shown in FIGS. 3–5 is the same as that of FIGS. 1 and 2. Accordingly, identical parts are designated with the same reference numeral while similar parts are designated with the same reference numeral followed by a prime (′). The main difference in the two embodiments resides in the construction of the sealing element.

The sealing element 9′ is shown to best advantage in FIG. 4. The sealing element includes a base surface 10′, a top surface 11′, an outer peripheral surface 12′, and an inner surface including the surface 13′ and lip 14′ connecting the base and top surfaces. In this embodiment of the invention the surface 13′ of the sealing element and the cooperating surface 17′ within cutout 15′ of the die 6′ are cylindrical and coaxial with the axis of the die. An advantage of this form of construction is a more positive securement of the sealing element on the die through a frictional engagement between the cooperating surfaces.

The outer wall 12′ of the sealing element 9′ (and, for that matter, sealing element 9) may be tapered slightly along the trailing end through a portion of its length 19. The portion 20 at at the forward end adjacent top surface 11′ is maintained at the maximum outer dimension as is permitted for use with the container 7. In this manner, the sliding seal with the inner container wall may be maintained over a reduced surface area.

Figure 6:
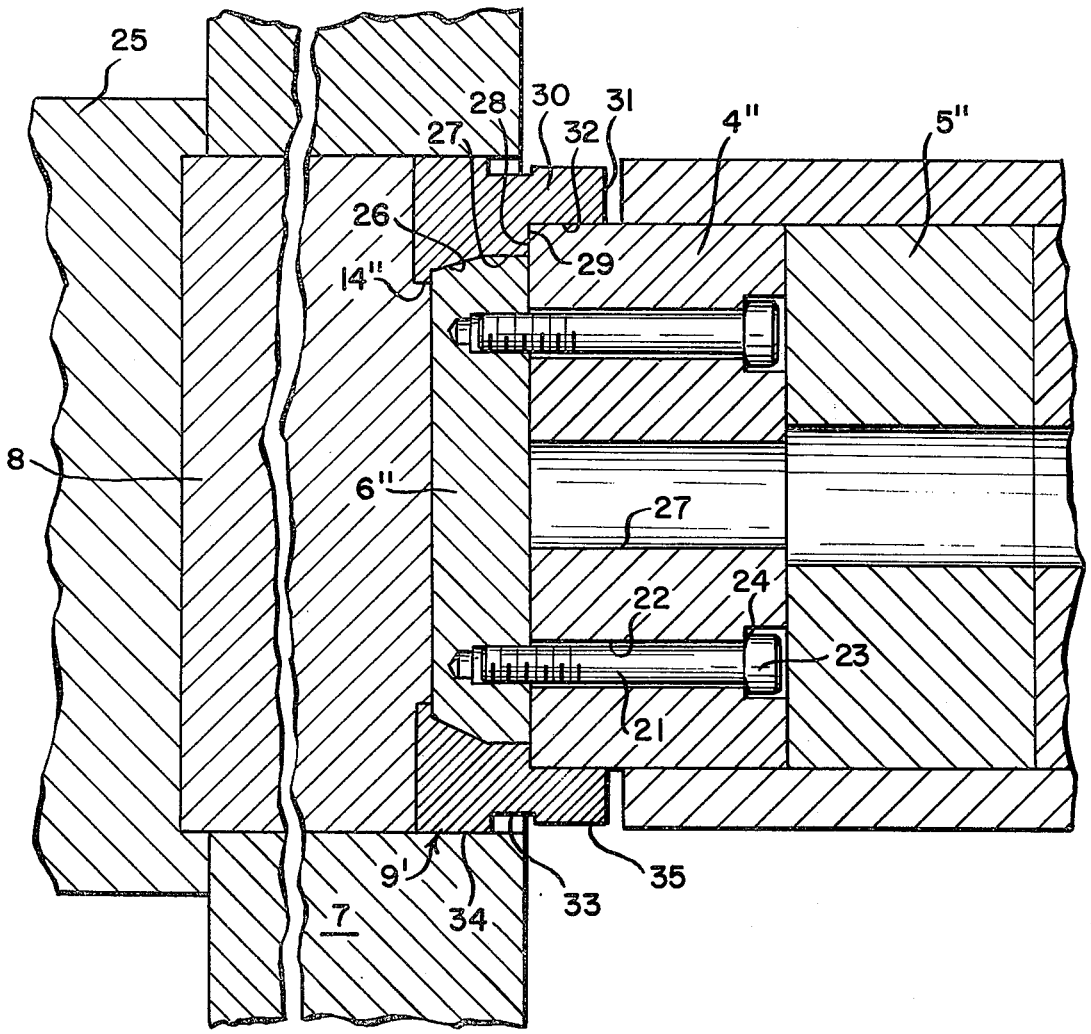
FIG. 6 is another view similar to FIG. 1 illustrating still another embodiment of the sealing element of the present invention.

In the embodiment of the invention shown in FIG. 6, the sealing element 9″ has the same basic structure as in the embodiments of FIGS. 1–5. However, the sealing element is longer in length than the sealing elements of FIGS. 1–5. In particular, the sealing element extends from the forward face of the die 6'' rearwardly of the die and around the first disc member 4''. As seen in FIg. 6, the inner wall surface of the sealing ring includes a first conical section 26 extending from immediately behind the lip 14'' part way down the complementary surface of the die. As shown, this surface is spaced slightly from the complementary surface of the die to preclude wedging. The inner surface of the sealing ring then becomes conical in shape at 27 and this section extends to the rearward face of the die 6''. The conical surfaces provide the radial alignment of the sealing element relative to the die.

It will be noted that the outer dimension of the die is less than the outer dimension of the forewardmost support disc 4'. The exposed annular forward surface 28 of the forwardmost disc 4'' formed by this construction provides a support shoulder; and the sealing ring is cut out along its inner wall surface to a complementary shape to provide an intermediate rearwardly facing base surface 29. As with the embodiments of FIGS. 1–5, the sealing member may be dimensioned so that the lip 14'' also provides a supporting function during extrusion strokes.

The sealing ring further includes a rearward section 30 which continues around the forwardmost disc 4'' and terminates in rear surface 31. This construction provides a second conical surface 32 which mates with the outer conical surface of the forwardmost disc 4'' and further assists in assuring radial alignment of the sealing member. In addition, this structure also assists to accurately hold the sealing member in axial alignment with respect to the ram structure and preclude twisting or canting as the ram is moved into the container 7. This in turn precludes jamming of the sealing element within the container during an extrusion stroke.

The outer surface of the sealing disc 9'' includes two surfaces separated by an annular groove 33. The first forwardmost surface 34 has an outer dimension corresponding to the inner dimension of the container 7 while the second rearwardmost surface 35 has a smaller diameter. The forwardmost surface 34 may have a tapered construction such as shown in FIG. 5, if desired.

The dies in the embodiments of the invention discussed above are removably mounted at the forward end of the ram structure. One form of mounting may be through provision of one or more bolts, such as bolts 21, which in the embodiments shown are equally spaced about an extrusion receiving opening 27 extending through the forwardmost disc. If the extrusion receiving opening is other than centrally disposed, a single bolt through a central bore would suffice in positive securement of the die to the forwardmost disc. The bolts are received through the bores 22 in the disc, threaded into the body of the die and maintained in axial position by interaction of the head 23 of the bolt within the counterbore 24 at the rearward end of the forwardmost disc. The bolts serve to secure the die in operative position as well as to maintain the relative positioning of the disc members. The position of each bore 22 will be determined by the positioning of the die openings in the dies and the communicating opening 27 in the discs.

The construction of the ram and the manner of mounting the same on the extrusion press may be as disclosed in U.S. Pat. Nos. 3,727,448 and 3,735,623.

In operation, a die 6, 6' or 6'', providing any desired die opening structure, i.e., single or multiple bores, a slit in straight or arcuate outline, or otherwise is removably mounted by a ram structure for movement within the container 7. The various disc members of the ram structure provide openings communicating with the openings in the die for passage of the extruded material. The openings in these blocks are preferably complementary in outline to the openings in the die and larger than the die openings so as not to develop unnecessary extruding friction. The container 7 having an outline to accept billets of various shapes such as round, rectangular or other cross-section is charged with a billet 8 from one end or the other and held therein by an end cover or gag plate 25.

After a complete extrusion stroke, the end cover or gag plate is first removed from the container. The sealing element, located within the container at the end opposite the entrance, is then removed from the ram 2 and the ram retracted through the container. Such retraction movement is easily carried out since the components of the ram have a smaller outer dimension than the inner dimension of the container. The container now is charged with a further billet to be extruded, the end cover is repositioned on the container, the sealing element is repositioned on the die, and the assembled structure is positioned to commence a subsequent extrusion operation.

We claim:

1. In combination:

a. a container providing an internal chamber adapted for receipt of a billet of material to be extruded;

b. means for sealing one end of said container;

c. a hollow elongated ram disposed coaxially with said container chamber adjacent its open end;

d. a die providing orifice means, 1. said die being positioned on one end of said ram so that upon relative movement of said container and die under extrusion forces and in extrusion direction, said billet material is extruded through said orifice means and passed through said ram; and e. a sealing element removably positioned in cooperating relationship with said die for movement with said die during the extrusion of said billet material, 1. said sealing element having an outer surface positioned in sliding sealing engagement with the inner wall surface container during an extrusion stroke and locating said die within and spaced from said inner wall surface, and 2. said sealing element including a radially inwardly directed lip overlying the forward face of the die to cover the line of juncture between the adjacent surfaces of said die and sealing element to prevent said billet material from extruding therebetween.

2. The combination of claim 1 wherein:

a. said sealing element is wholly supported by said die.

3. The combination of claim 1 wherein:

a. said sealing element is supported on said die against relative axial movement during an extrusion stroke.

4. The combination of claim 1 wherein:

a. the forward face of said die underlies said sealing element in supporting relation to the lip of the sealing element.

5. The combination of claim 1 wherein:

a. said die includes a shoulder rearwardly of its forward face extending laterally of the direction of axial extrusion forces for supporting said sealing element.

6. The combination of claim 5 wherein:

a. said adjacent surfaces are mating surfaces and extend from the forward face to the shoulder in a direction substantially coaxial to the direction of axial extrusion forces.

7. The combination of claim 5 wherein:

a. the adjacent surfaces which extend from the forward face to the shoulder are mating beveled surfaces complementary to one another.

8. The combination of claim 1 wherein:

a. the adjacent surfaces extend from the forward face to the rearward face first in a spaced conical relation and then in a mating coaxial relation relative to the direction of axial extrusion forces.

9. The combination of claim 1 wherein:

a. the outer dimension of the die is less than the outer dimension of the ram; and b. the sealing element has:

1. an inner surface complementary to the outer surface of the die terminating in an intermediate base surface aligned with the forward exposed surface of the ram, and
2. a rearward section disposed about the forward end of the ram in mating relation therewith.

10. A sealing element adapted to be positioned in association with a die, and at least partially in front and partially around said die to define a line of juncture, prior to extrusion of material from a billet of extrudable material confined within a supporting container, said sealing element having:

a. an outer dimension in excess of the outer dimension of said die, said outer dimension being substantially equal to the inner dimension of said container during an extrusion stroke to cooperate with the inner wall of said container during said extrusion stroke in sliding, sealing engagement;

b. a laterally inwardly directed lip overlying the line of juncture of said die and sealing element to prevent said billet material from extruding therebetween; and c. said sealing element being adapted to be releasably positioned in front of and around said die for removal upon completion of an extrusion stroke to permit unrestrained relative axial movement of said die through said container.

11. The sealing element of claim 10 further having:

a. a seating surface for positioning said element directly on a complementary shaped surface on the die.

12. The sealing element of claim 11 wherein:

a. the shape thereof is annular with a tapered inner wall behind said lip extending to said seating surface.

13. The sealing element of claim 11 wherein:

a. the shape thereof is annular with a cylindrical inner wall behind said lip extending to said seating surface.

14. The sealing element of claim 10 wherein:

a. the shape thereof is annular with an inner wall which is tapered immediately behind said lip and then cylindrical to the rearward face of the die.

15. The sealing element of claim 10 wherein:

a. the sealing element extends rearwardly beyond the die with an inner surface adapted to mate in surrounding relation with ram structure on which the die is to be mounted.

16. The sealing element of claim 15 further including:

a. a rearwardly facing base surface at the rearward face of the die adapted to sit on the forward end of ram structure on which the die is to be mounted.

17. The sealing element of claim 10 wherein:

a. the shape thereof is annular with an outer wall which is part cylindrical and part tapered.

* * * * *